US008910543B2

(12) United States Patent
Nebuya et al.

(10) Patent No.: US 8,910,543 B2
(45) Date of Patent: Dec. 16, 2014

(54) PEDAL DEVICE

(75) Inventors: Hideto Nebuya, Saitama (JP); Shinji Oka, Saitama (JP); Toru Ebara, Tokyo (JP); Masato Kobayashi, Tochigi (JP); Teruo Kato, Tochigi (JP)

(73) Assignees: Honda Motor Co., Ltd., Tokyo (JP); F-Tech Inc., Saitama (JP)

( * ) Notice: Subject to any disclaimer, the term of this patent is extended or adjusted under 35 U.S.C. 154(b) by 327 days.

(21) Appl. No.: 12/818,427

(22) Filed: Jun. 18, 2010

(65) Prior Publication Data

US 2010/0319480 A1 Dec. 23, 2010

(30) Foreign Application Priority Data

Jun. 19, 2009 (JP) ..... 2009-146734

(51) Int. Cl.
*G05G 1/44* (2008.04)
*G05G 1/36* (2008.04)
*G05G 1/46* (2008.04)

(52) U.S. Cl.
CPC .. *G05G 1/44* (2013.01); *G05G 1/36* (2013.01); *G05G 1/46* (2013.01)
USPC ..... 74/560; 74/513

(58) Field of Classification Search
CPC ..... G05G 1/36; G05G 1/30; G05G 1/46; G05G 1/487; G05G 1/506
USPC ..... 74/512–514, 560, 563; 24/458; 16/257; 403/329, 397, DIG. 7
IPC ..... G05G 1/36, 1/44
See application file for complete search history.

(56) References Cited

U.S. PATENT DOCUMENTS

| | | | | | |
|---|---|---|---|---|---|
| 1,428,082 | A * | 9/1922 | Gammon | 74/513 |
| 1,821,589 | A * | 9/1931 | Thorp | 74/513 |
| 2,167,868 | A * | 8/1939 | Best | 74/513 |
| 2,200,047 | A * | 5/1940 | Tinnerman | 248/73 |
| 2,484,592 | A * | 10/1949 | Rodd | 74/513 |
| 2,532,189 | A * | 11/1950 | Pinardi et al. | 74/513 |
| 3,023,470 | A * | 3/1962 | Patten | 403/397 |
| 3,111,861 | A * | 11/1963 | Young | 74/560 |
| 3,500,702 | A * | 3/1970 | Nautsch et al. | 74/560 |
| 6,494,115 | B1 * | 12/2002 | Haugen et al. | 74/562 |
| 7,717,012 | B2 * | 5/2010 | Kim et al. | 74/512 |
| 7,946,192 | B2 * | 5/2011 | Kim et al. | 74/513 |
| 2005/0217410 | A1 | 10/2005 | Sakuraba et al. | |
| 2007/0193401 | A1 * | 8/2007 | Campbell | 74/560 |

FOREIGN PATENT DOCUMENTS

| | | | |
|---|---|---|---|
| JP | 06-033726 | U | 5/1994 |
| JP | 2002-004564 | A | 1/2002 |
| JP | 2004-106776 | A | 4/2004 |
| JP | 2006-205928 | A | 8/2006 |

* cited by examiner

*Primary Examiner* — Thomas Diaz
(74) *Attorney, Agent, or Firm* — Carrier Blackman & Associates, P.C.; Joseph P. Carrier; Jeffrey T. Gedeon

(57) ABSTRACT

An object of the present invention is to provide a pedal device in which the pad member can be fixed to the stopper member easily at the time of mounting, and which does not tend to be degraded over the years. In order to achieve the above object, the present invention provides a pedal device including: a stopper member attached to a floor of a driver's seat of a vehicle; and a pad member which has a pad fitted into the stopper member and receives a depression force exerted by a driver.

6 Claims, 7 Drawing Sheets

PEDAL DEVICE

CROSS-REFERENCE TO RELATED APPLICATION

The present application claims benefit of the filing date of Japanese Patent Application No. 2009-146734 filed on Jun. 19, 2009 which is incorporated herein by reference.

BACKGROUND OF THE INVENTION

1. Field of the Invention

The present invention relates to a pedal device which is provided in a vehicle.

2. Description of Related Art

For example, a pedal (an organ pedal) whose fulcrum is on a floor side of a vehicle body may be used as an accelerator pedal of a vehicle. JP 2004-106776 A discloses an accelerator pedal in which a pad member is fixed to a stopper member by a snap-fit mechanism by which a nail member including a nail provided on a resinous pad member is engaged with the stopper member on a vehicle body side at the time of mounting.

According to the technique disclosed in JP 2004-106776 A, the nail is engaged with the stopper member by the snap-fit mechanism which elastically deforms a supporting plate which connects the nail to the resinous pad member. Therefore, the supporting plate should be formed to be thin so that it can be elastically deformed enough.

Also, because the nail is engaged with the stopper member by elastically deformed supporting plate, an amount of deformation of the supporting plate increases when the nail is large. Therefore, the nail should be made to be small so as to suppress the amount of deformation of the supporting plate.

Therefore, there arises a problem that the accelerator pedal tends to be degraded over the years because the strength of the nail member including the supporting plate and the nail decreases.

Therefore, an object of the present invention is to provide a pedal device in which the pad member can be fixed to the stopper member easily at the time of mounting, and which does not tend to be degraded over the years.

SUMMARY OF THE INVENTION

In order to solve the above problem, the present invention provides a pedal device including: a stopper member attached to a floor of a driver's seat of a vehicle; and a pad member which is fitted into the stopper member and has a pad to receives a depression force exerted by a driver. Also, the pad member includes a pad-side fitting section on which an engagement nail which can be elastically deformed and a fitting nail whose stiffness is higher than that of the engagement nail are formed; and a hinge section to connect the pad to the pad-side fitting section, in which the stopper member has a stopper-side fitting section including an engagement section with which the engagement nail is engaged, and an insertion section into which the fitting nail is inserted, and the fitting nail is formed at a location which is opposite to the hinge section.

According to the present invention, the pedal device, in which the fitting nail to be inserted into the insertion section of the stopper member is provided at the pad-side fitting section to which the pad receiving the depression force exerted by the driver is connected via the hinge section, can be provided. Also, the fitting nail is formed at the location which is opposite to the hinge section.

The fitting nail is configured to have a stiffness which is higher than that of the engagement nail formed at the pad-side fitting section, and can receive a load applied to the pad-side fitting section via the hinge section. Therefore, the pad member is made to enhance its strength to the load, thereby resulting in the pad member which does not tend to be degraded over the years.

Also, the fitting nail of the pad-side fitting section is inserted into the insertion section of the stopper-side fitting section, the engagement nail of the pad-side fitting section is engaged with the engagement section of the stopper-side fitting section, and the pad member is fixed to the stopper member by the snap-fit mechanism.

Also, the pedal device according to the present invention further includes a bracket which is fixed to the floor, and to which the stopper member is attached, and the bracket is provided with a supporting section to support at least one of the engagement nail which is engaged with the engagement section and the engagement section from the floor side.

According to the present invention, when the engagement nail of the pad member is engaged with the engagement section of the stopper member, at least one of the engagement nail and the engagement section can be supported by the supporting section provided on the bracket from the floor side. Therefore, the engagement nail of the pad member can be prevented from being bent in a direction departing from the engagement section of the stopper member, thereby being prevented from coming off the engagement section of the stopper member.

Also, the engagement section of the stopper member can be prevented from being bent, thereby preventing the engagement nail of the pad member from coming off the engagement section of the stopper member.

Also, even if a load is applied to the stopper member in a direction towards the floor, the stopper member can be prevented from being operated towards the floor side.

DETAILED DESCRIPTION OF THE EMBODIMENTS

Hereinafter, referring to FIGS. 1-7, embodiments of the present invention will be explained in detail.

Figure 1:
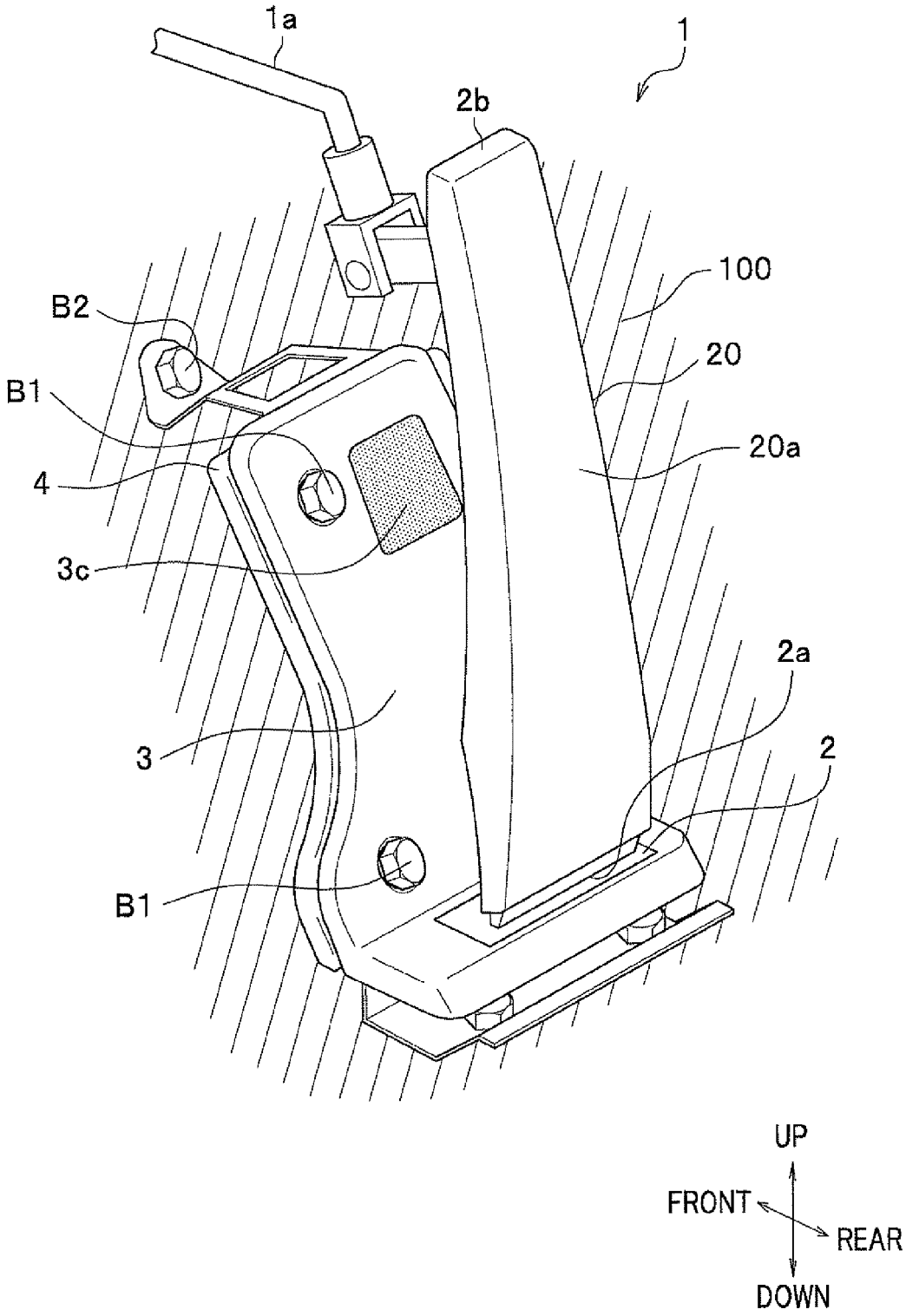
FIG. 1 is a perspective view of an embodiment of a pedal device according to the present invention.

As shown in FIG. 1, for example, a pedal device 1 according to this embodiment is fixed to a floor 100 of a driver's seat in a vehicle as an accelerator pedal of the vehicle, and includes a pad member 2 including a pad 20 depressed by receiving depression force exerted by the driver; and a stopper bracket 3 used as a stopper member to fix the pad member 2 to the floor 100 via a mounting bracket 4. Although the mounting bracket 4 will be explained in detail later, for example, the mounting bracket 4 is fixed to the floor 100 by a bolt B2. The stopper bracket 3 is formed into a configuration which is along the floor 100. For example, when the floor 100 rises at front of the vehicle, the stopper bracket 3 may be formed to have an approximately L shaped cross section. The pad member 2 is fitted into the stopper bracket 3 via a structure described later, and the stopper bracket 3 is attached to the mounting bracket 4 by a plurality of bolts B1.

A fulcrum 2*a* is formed at the side of the floor 100 of the pad 20, and the pad 20 is turned around the fulcrum 2*a* in response to the depression force exerted by a driver from a upright condition to a reclined condition relative to the floor 100. That is, the pad 20 is reclinable relative to the floor 100. Also, an arm 1*a* to drive a throttle valve (not shown) is attached to a tip 2*b* (an end opposite to the fulcrum 2*a*) of the pad 20.

The arm 1*a* is provided with a biasing unit (not shown), and is biased in a direction in which the pad 20 is made to be upright relative to the floor 100. According to this structure, the pad 20 is supported to be upright relative to the floor 100 when the driver does not depress the pad 20.

In addition, a contact section 3*c* is formed on the stopper bracket 3 by affixing an elastic body at a location to which the reclined pad 20 is touched.

When the driver depresses the pad 20 by applying the depression force to the depressed surface 20*a* of the pad 20, the arm 1*a* increases an opening degree of the throttle valve (not shown) so that a revolution speed of an engine (not shown) is increased.

When the driver stops depressing the pad 20 and releases the pad 20, the opening degree of the throttle valve (not shown) is decreased by a force from the biasing unit (not shown) of the arm 1*a*, the revolution speed of the engine (not shown) is decreased, and the pad 20 is made to be upright relative to the floor 100.

Figure 2:
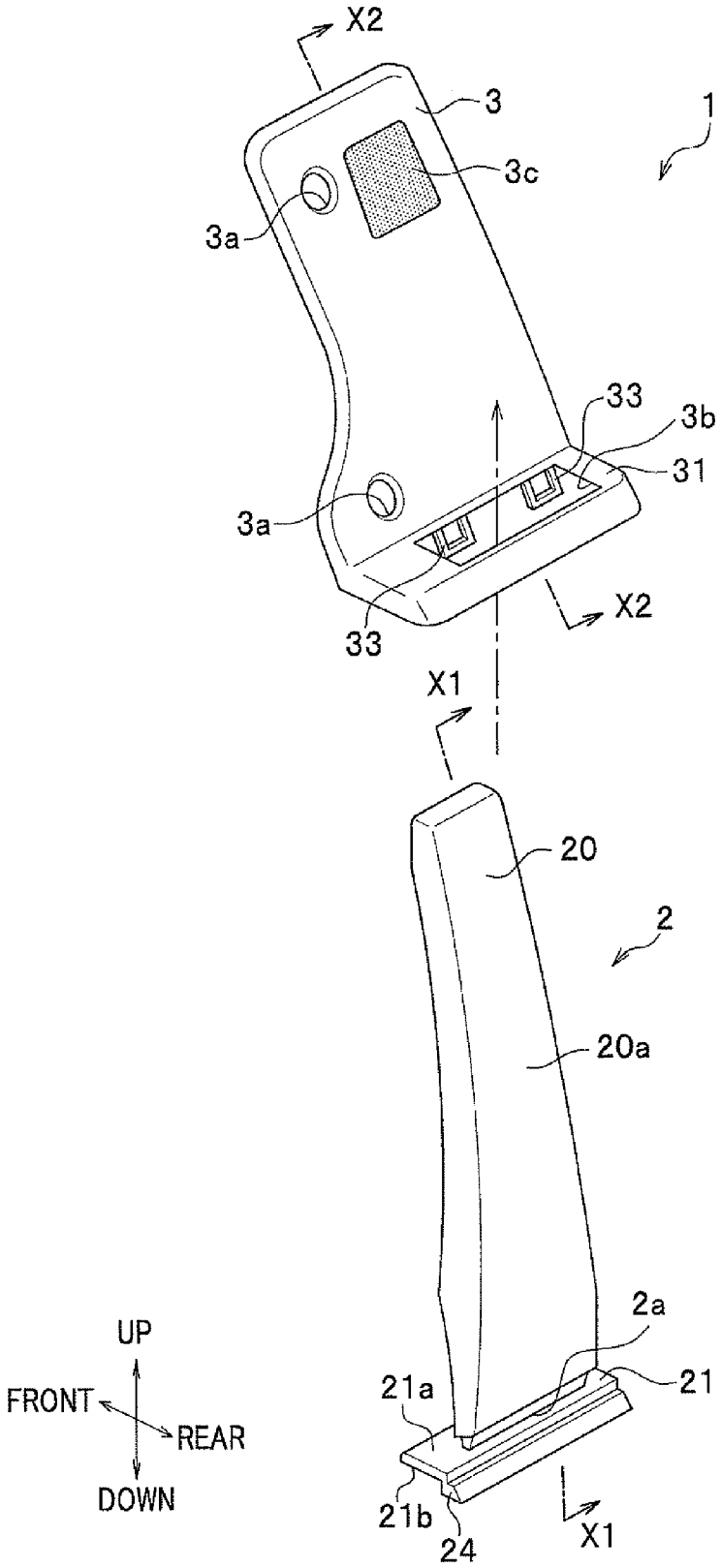
FIG. 2 is a view showing that a pad member is going to be fitted into a stopper bracket.

As shown in FIG. 2, for example, the pedal device 1 according to this embodiment shown in FIG. 1 is configured by attaching the pad member 2 provided with the pad 20 to the stopper bracket 3 made of polypropylene (PP).

As shown in FIG. 2, the pad member 2 of the pedal device 1 according to this embodiment is fitted into the stopper bracket 3 from below (from the side which is fixed to the floor 100, see FIG. 1). The stopper bracket 3 has a rectangular through hole 3*b*, and the pad 20 passes through the through hole 3*b* from below so as to be located above the stopper bracket 3.

Figure 3B:
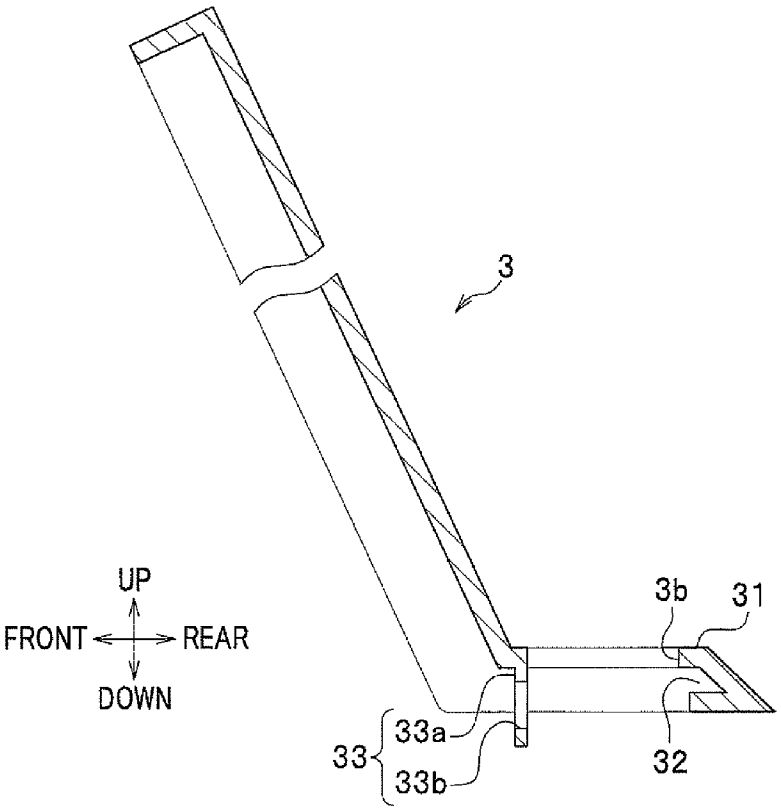
FIG. 3B is a sectional view taken along the line X2-X2 of FIG. 2.
Figure 3A:
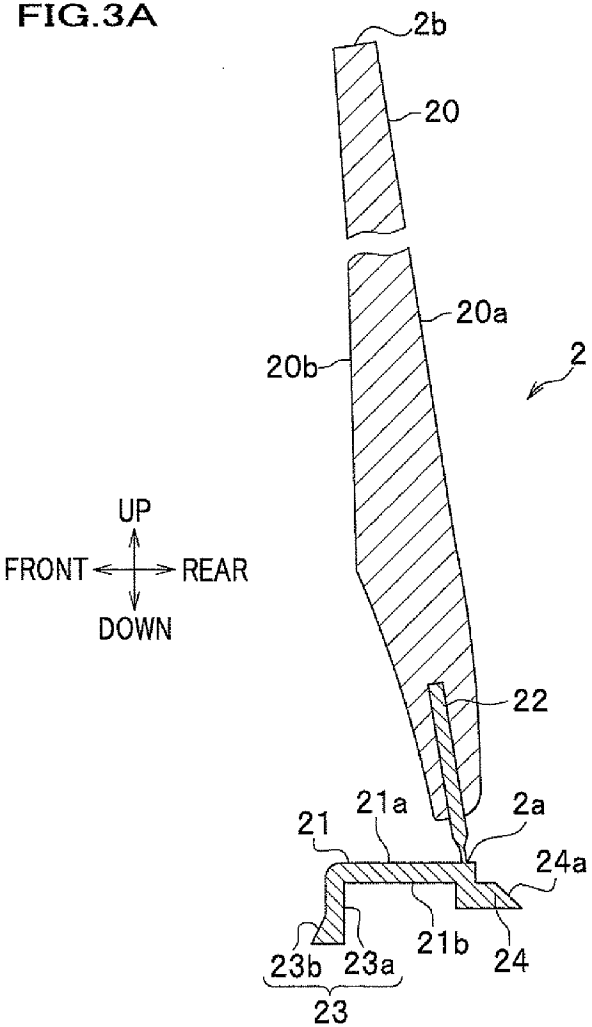
FIG. 3A is a sectional view taken along the line X1-X1 of FIG. 2.

As shown in FIG. 3A, the pad member 2 includes a pad-side fitting section 21, a hinge section 22, and the pad 20. The pad-side fitting section 21 and the hinge section 22 are made of a relatively flexible resin, the pad-side fitting section 21 is fitted into the stopper bracket 3 by fitting into the through hole 3*b* of the stopper bracket 3 (see FIG. 2), and the hinge section 22 is formed so that it extends from the pad-side fitting section 21 upward. Also, for example, the pad 20 is made by insert-molding the hinge section 22.

Therefore, the hinge section 22 connects the pad 20 to the pad-side fitting section 21 integrally.

In addition, the pad 20 may be fixed to the hinge section 22 by adhesion or welding.

Also, the pad 20 has the depressed surface 20*a* to be depressed by the driver. The depressed surface 20*a* is oriented toward rear of the vehicle so as to face the driver.

Also, a back surface 20*b* of the pad 20 is opposite to the depressed surface 20*a*. The back surface 20*b* is oriented toward front of the vehicle.

For example, the hinge section 22 is a thin plate member, and extends from the top face 21*a* of the pad-side fitting section 21 upward so that a surface of the hinge section 22 is oriented to the same direction of that of the depressed surface 20*a* of the pad 20. A connecting section between the hinge section 22 and the pad-side fitting section 21 is thinned locally so as to form a resinous hinge. The hinge section 22 is configured to be reclined toward front of the vehicle from the upright condition (i.e., reclinable) relative to the pad-side fitting section 21 so that the depressed surface 20*a* is oriented to the driver. Also, the fulcrum 2*a* of the pad 20 is formed by the resinous hinge.

In the pad member 2 configured as above, the hinge section 22 is provided on the top face 21*a* of the pad-side fitting section 21. In addition, for example, the hinge section 22 may be attached to the pad-side fitting section 21 by a hinge structure whose rotation axis is a pin (not shown).

As shown in FIG. 3A, the hinge section 22 is formed in the vicinity of an end of the pad-side fitting section 21 whose shape is rectangular in a plan view at a rear side of the vehicle.

Also, a fitting nail 24 to fit into the stopper bracket 3 (see FIG. 2) is formed on an opposite side of the pad-side fitting section 21 under the hinge section 22, i.e., on a bottom face 21*b* of the pad-side fitting section 21 at a location which is opposite to the hinge section 22.

The fitting nail 24 projects from an end of the pad-side fitting section 21 toward rear of the vehicle, and is formed on the bottom face 21*b* of the pad-side fitting section 21 on which the hinge section 22 is formed along the end of the pad-side fitting section 21.

For example, the fitting nail 24 is formed by making a portion which is opposite to the hinge section 22 of the bottom face 21*b* to be thick so as to improve a stiffness, and by making the thick portion to project toward rear of the vehicle.

Therefore, the pad-side fitting section 21 has a portion of high stiffness because the hinge section 22 is formed at the portion and the portion is made to be thick toward the bottom face 21*b*.

Also, on the fitting nail 24, a sloped section 24*a* which slopes toward the pad-side fitting section 21 upward is formed at a portion which projects toward rear of the vehicle.

Further, at a vehicle front side of the pad-side fitting section 21, an engagement nail 23 is formed.

The engagement nail 23 includes a supporting plate 23*a* which is formed at a front end of the pad-side fitting section 21 so that it extends from the bottom face 21*b* downward in a vertical direction, and an engagement projection 23*b* which projects from a lower end of the supporting plate 23*a* forward. The engagement projection 23*b* slopes toward the pad-side fitting section 21 upward. Also, the supporting plate 23*a* is formed to be deformed elastically by elasticity of the resinous pad-side fitting section 21.

In addition, the engagement nail 23 is formed corresponding to a location of a described later engagement section 33 (see FIG. 3B) provided on the stopper bracket 3 (see FIG. 2).

Also, it is desirable that the fitting nail 24 is formed to have higher stiffness than that of the supporting plate 23*a* of the engagement nail 23.

Next, a configuration of the stopper bracket 3 according to this embodiment will be explained.

As shown in FIG. 3B, the stopper bracket 3 is formed along the floor 100 (see FIG. 1) and has an approximately L shaped cross section when the floor 100 rises at front of the driver's seat.

The stopper bracket 3 has a stopper-side fitting section 31 at which the pad 20 is located (see FIG. 3A), and the stopper-side fitting section 31 has the through hole 3*b* through which the pad 20 passes. Also, the stopper-side fitting section 31 is provided with a concave insertion section 32 into which the fitting nail 24 of the pad member 2 is inserted (see FIG. 3A).

The insertion section 32 is formed by bending an end of the stopper-side fitting section 31 downward so that a side shape of the stopper-side fitting section 31 is approximately the same as that of the fitting nail 24 of the pad member 2 (see FIG. 3A). The insertion section 32 is a region into which the fitting nail 24 is inserted when the pad member 2 is fitted into the stopper bracket 3 (see FIG. 3A).

In addition, a front side of the insertion section 32 is opened.

Also, at a peripheral portion on a front side of the through hole 3*b*, at least one engagement section 33 with which the engagement nail 23 of the pad member 2 (see FIG. 3A) is engaged is formed.

The engagement section 33 is configured by making an engagement hole 33*b* on the supporting plate 33*a* extending from the peripheral portion of the through hole 3*b* below the stopper-side fitting section 31. The engagement hole 33*b* is made so that the engagement projection 23*b* of the engagement nail 23 (see FIG. 3A) is engaged with the engagement hole 33*b* when the pad member 2 (see FIG. 3A) is attached to the stopper bracket 3.

A procedure by which a worker who assembles the pedal device 1 (see FIG. 1) fits the above described pad member 2 (see FIG. 3A) into the stopper bracket 3 (see FIG. 3B) will be explained.

Figure 4A:
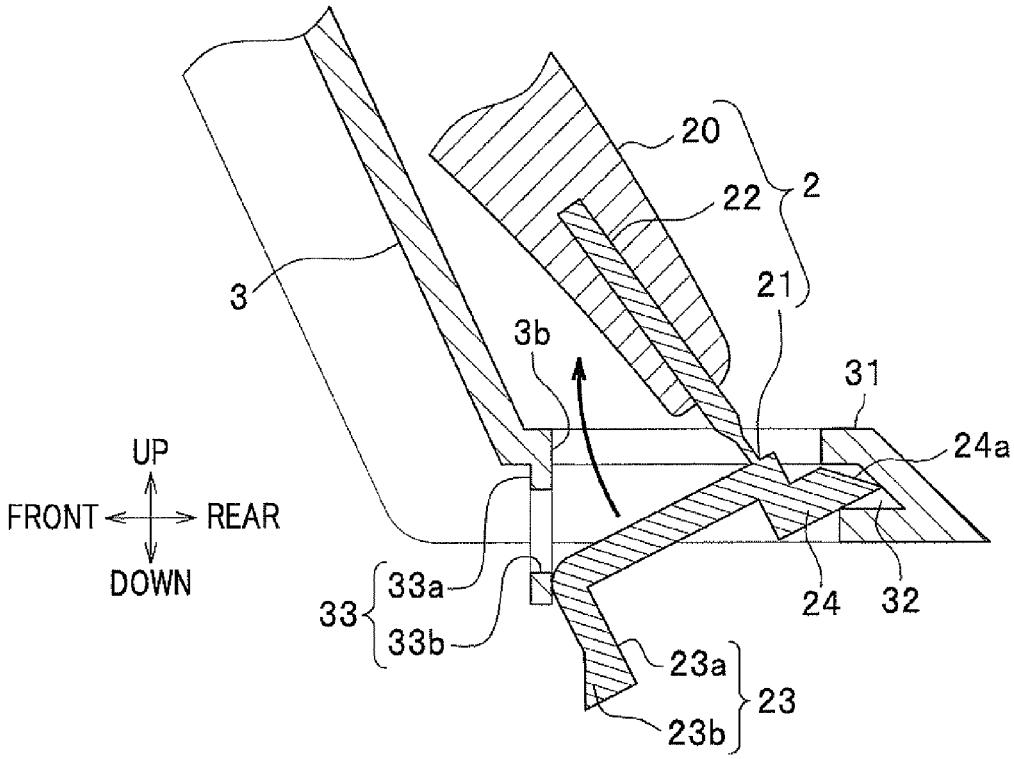
FIG. 4A is a sectional view showing that the pad member is applied to the stopper bracket from below.

As shown in FIG. 4A, the worker applies the pad member 2 to the stopper bracket 3 from below so that the pad 20 passes through the through hole 3*b*, and inserts a tip of the fitting nail 24 into the insertion section 32.

At this time, because the sloped section 24*a* is formed at the fitting nail 24, the stopper bracket 3 does not interfere with the fitting nail 24. Therefore, the pad member 2 is tilted so that the engagement nail 23 is below the stopper bracket 3.

Next, the worker rotates the pad member 2 about the fitting nail 24 which serves as a fulcrum in the direction of the arrow by raising the engagement nail 23.

Figure 4B:
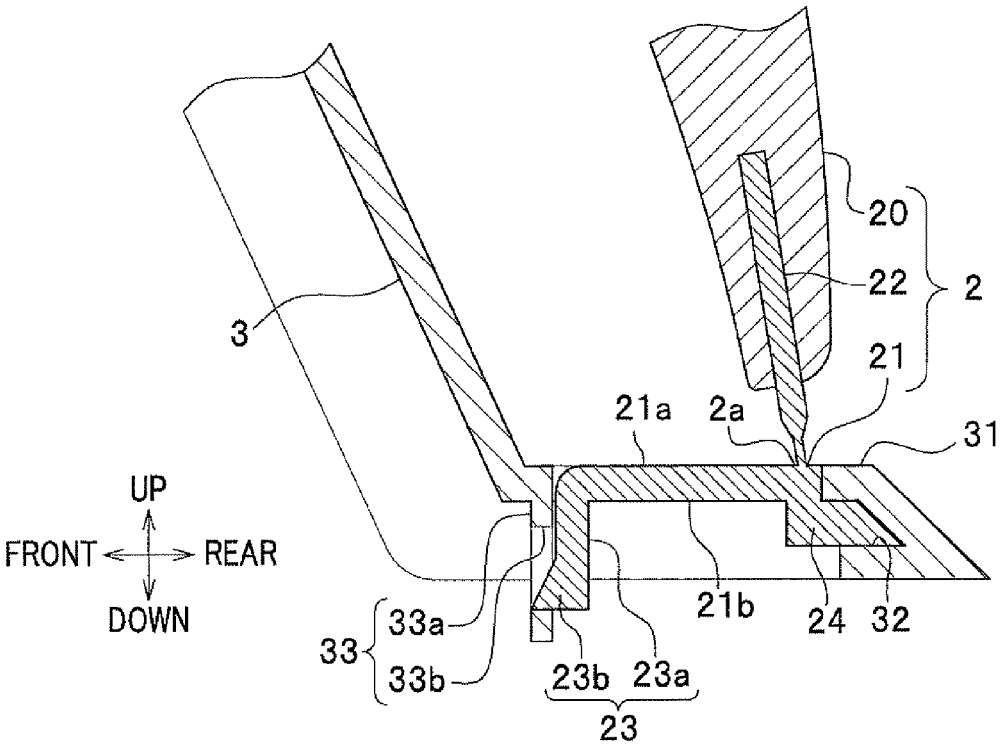
FIG. 4B is a sectional view showing that the pad member is fitted into the stopper bracket.

The supporting plate 23*a* of the engagement nail 23 is deformed elastically by the supporting plate 33*a* of the engagement section 33. As shown in FIG. 4B, when the engagement projection 23*b* is moved to the position of the engagement hole 33*b*, the engagement projection 23*b* is engaged with the engagement hole 33*b* by an elastic force of the resin. By such a structure, the pad member 2 is fixed to the stopper bracket 3 by a snap-fit mechanism.

As described above, the pad-side fitting section 21 is fitted into the through hole 3*b*, the fitting nail 24 is inserted into the insertion section 32, the engagement nail 23 is engaged with the engagement section 33, and the pad member 2 is fitted into the stopper bracket 3.

At this time, a juncture between the pad member 2 and the stopper bracket 3 may be fixed by an adhesive. According to this structure, the pad member 2 can be surely suppressed to be tottering.

The fitting nail 24 is inserted into the insertion section 32, the engagement nail 23 is engaged with the engagement section 33, and the pad member 2 is fixed to the stopper bracket 3 by the snap-fit mechanism. Therefore, an adhesive strength of the adhesive may be low as long as the pad member 2 and the stopper bracket 3 are suppressed to be tottering.

When the driver depresses the pad 20, a load is applied to the pad-side fitting section 21 of the pad member 2 from the fulcrum 2*a* downward.

As shown in FIG. 4B, because the fitting nail 24 is formed below the fulcrum 2*a* of the pad 20, the portion which is opposite to the fulcrum 2*a* of the pad 20 is made to be thick at the bottom face 21*b* of the pad-side fitting section 21 so as to improve the stiffness as described above. Therefore, the pad-side fitting section 21 of the pad member 2 is formed to be thick, receives the load applied from the fulcrum 2*a* by the fitting nail 24 having high stiffness, and the strength of the pad member 2 is improved to the load applied from the fulcrum 2*a*. As a result, the pedal device 1 which does not tend to be degraded over the years (see FIG. 1) can be obtained.

Also, because the fitting nail 24 is inserted into the insertion section 32 of the stopper bracket 3, the fitting nail 24 of the pad member 2 fitted into the stopper bracket 3 obtains the same effect as that of being reinforced with the insertion section 32 so as to have higher strength. Therefore, in the pedal device 1 (see FIG. 1), the strength of the pad member 2 is improved to the load applied from the fulcrum 2*a*. As a result, the pedal device 1 which does not tend to be degraded over the years can be obtained.

Also, the pad member 2 can receives the load applied from the fulcrum 2*a* by the thick fitting nail 24, and the engagement nail 23 whose stiffness is lower than that of the fitting nail 24 can be prevented from receiving a large load.

Therefore, the engagement nail 23 whose stiffness is lower than that of the fitting nail 24 can be suppressed to be degraded over the years. As a result, the pedal device 1 (see FIG. 1) which does not tend to be degraded over the years can be obtained.

As described above, the stopper bracket 3 into which the pad member 2 is fitted is attached to the floor 100 (see FIG. 1), thereby resulting in the pedal device 1 (see FIG. 1).

Figure 5A:
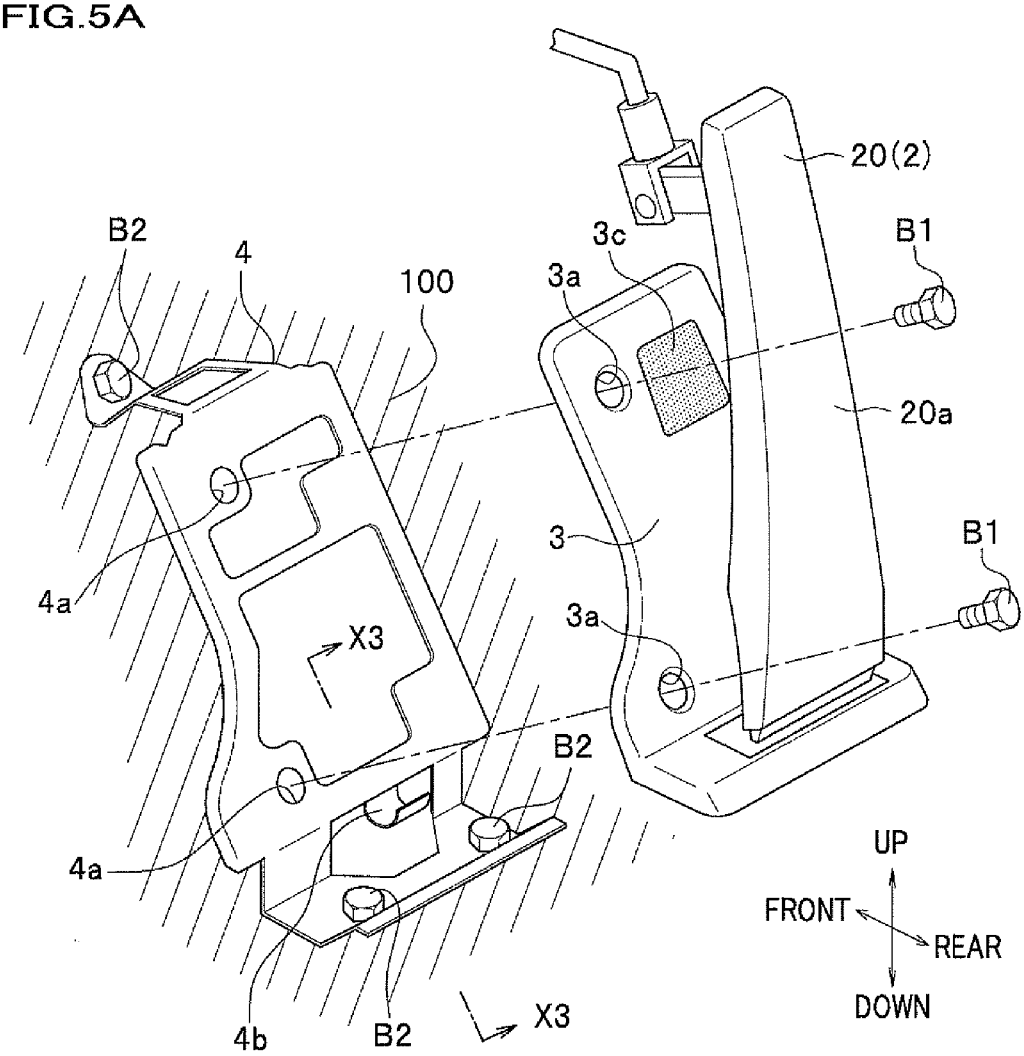
FIG. 5A is a view showing that the stopper bracket into which the pad member is fitted is going to be attached to a mounting bracket.

As shown in FIG. 5A, the mounting bracket 4 is fixed to the floor 100 as a bracket to attach the stopper bracket 3 into which the pad member 2 is fitted.

For example, the mounting bracket 4 is formed by pressing a sheet metal, is fixed to the floor 100 by a plurality of bolts B2, and has a plurality of bolt holes 4*a* into which a plurality of bolts B1 are screwed so as to attach the stopper bracket 3.

The stopper bracket 3 has a plurality of fixing holes 3*a*, and the plurality of bolts B1 are screwed into the plurality of bolt holes 4*a* of the mounting bracket 4 through the fixing holes 3*a* so as to attach the stopper bracket 3 to the mounting bracket 4.

Also, the mounting bracket 4 is provided with a pad supporting section 4*b* which serves as a supporting section to support the stopper bracket 3, into which the pad member 2 is fitted, from the side of the floor 100.

Figure 5B:
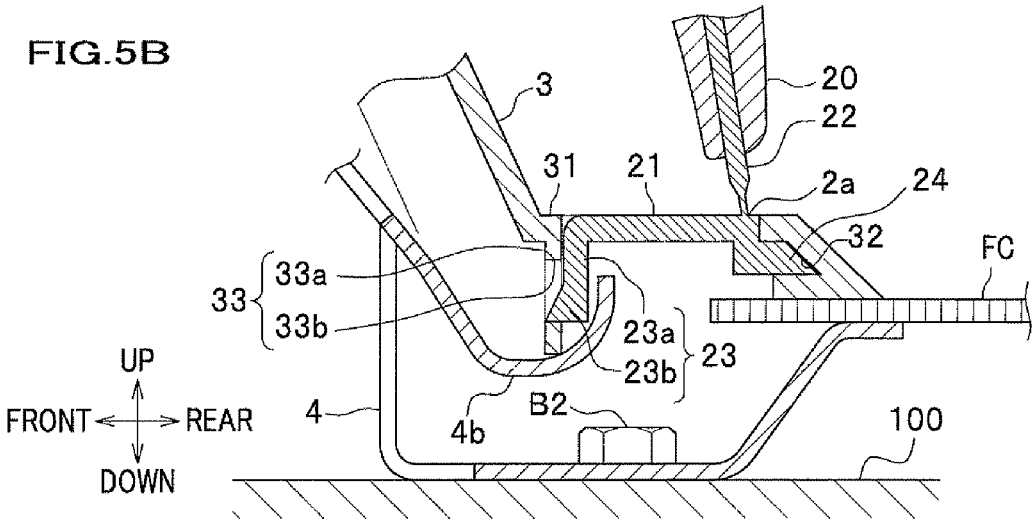
FIG. 5B is a sectional view taken along the line X3-X3 of FIG. 5A with the stopper bracket being attached to the mounting bracket.

Specifically, as shown in FIGS. 5A and 5B, the pad supporting section 4*b* is formed at a location corresponding to the engagement section 33 of the stopper bracket 3 by bending a part of the mounting bracket 4 so as to support at least one of the engagement section 33 and the engagement nail 23 from the side of the floor 100.

In addition, a floor carpet FC to be laid on the floor 100 may be sandwiched between the mounting bracket 4 and the stopper bracket 3.

As shown in FIG. 5B, the pad supporting section 4*b* is configured to support at least one of the engagement nail 23 and the engagement section 33 from the side of the floor 100 when the engagement nail 23 formed on the pad-side fitting section 21 is engaged with the engagement section 33 formed on the stopper-side fitting section 31.

If the engagement nail 23 or the engagement section 33 is bent with the engagement nail 23 of the pad-side fitting section 21 being engaged with the engagement section 33 of the stopper-side fitting section 31, the engagement nail 23 may possibly come off the engagement section 33. However, by supporting at least one of the engagement nail 23 and the engagement section 33 from the side of the floor 100 with the pad supporting section 4*b*, the engagement nail 23 and the engagement section 33 can be suppressed to be bent, and the engagement nail 23 is effectively prevented from coming off the engagement section 33.

Also, when the driver depresses the pad 20, a load is applied to the pad member 2 downward (i.e., toward the floor 100), the pad member 2 is moved to the side of the floor 100, and the driver may feel uncomfortable that the pad 20 sinks.

By supporting at least one of the engagement nail 23 and the engagement section 33 from the side of the floor 100 with the pad supporting section 4*b* with the engagement section 33 of the stopper-side fitting section 31 being engaged with the engagement nail 23 of the pad-side fitting section 21, the pad member 2 can be prevented from moving to the side of the floor 100. As a result, the uncomfortable feeling of the driver can be reduced.

Figure 6A:
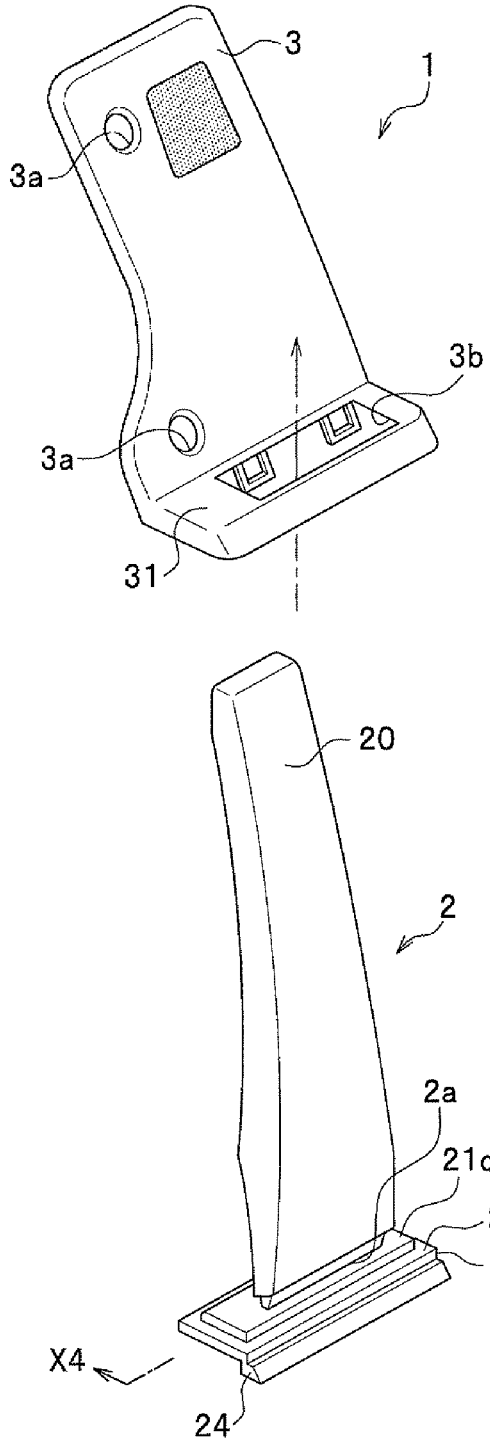
FIG. 6A is a view showing that the pad member on which a convex section is formed is going to be fitted into the stopper bracket.
Figure 6B:
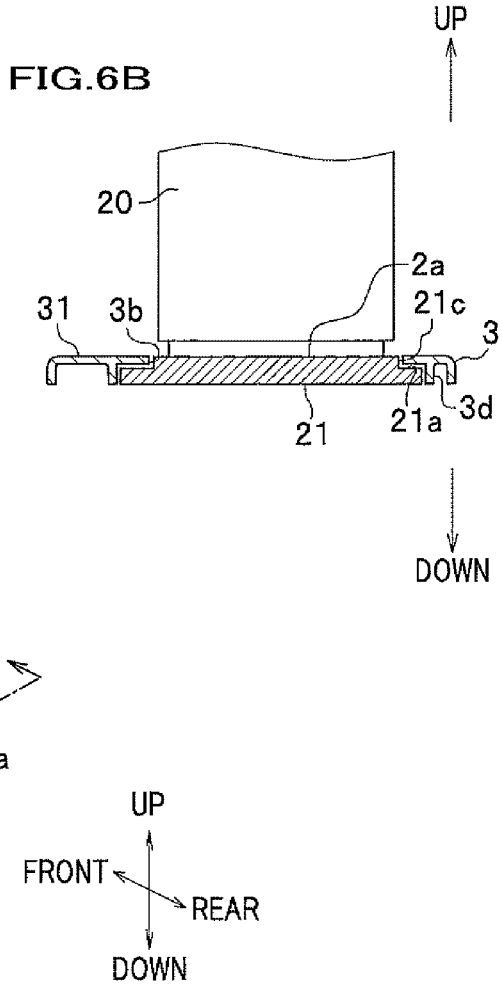
FIG. 6B is a sectional view taken along the line X4-X4 with the pad member being fitted into the stopper bracket.

Also, as shown in FIG. 5B, the fitting nail 24 is inserted into the insertion section 32 of the stopper bracket 3 so as to be limited to move upward in the pad member 2 according to this embodiment. However, as shown in FIG. 6A, the pad-side fitting section 21 may be made larger than the through hole 3*b* of the stopper bracket 3, and a convex section 21*c* which is fittable into the through hole 3*b* may be provided on the top face 21*a* so as to form the hinge section 22 at the convex section 21*c*.

When constructed as described above, as shown in FIG. 6B, the pad member 2 is attached to the stopper bracket 3 so that the convex section 21*c* is fitted into the through hole 3*b*, and the top face 21*a* of the pad-side fitting section 21 is located so as to extend circumferentially under the through hole 3*b*. Therefore, the pad member 2 is limited to move upward by the pad-side fitting section 21, and is surely fixed to the stopper bracket 3.

Further, for example, if a locking wall 3*d* to surround the pad-side fitting section 21 is provided under the stopper-side fitting section 31 of the stopper bracket 3, the pad member 2 can be effectively suppressed to be tottering.

Figure 7A:
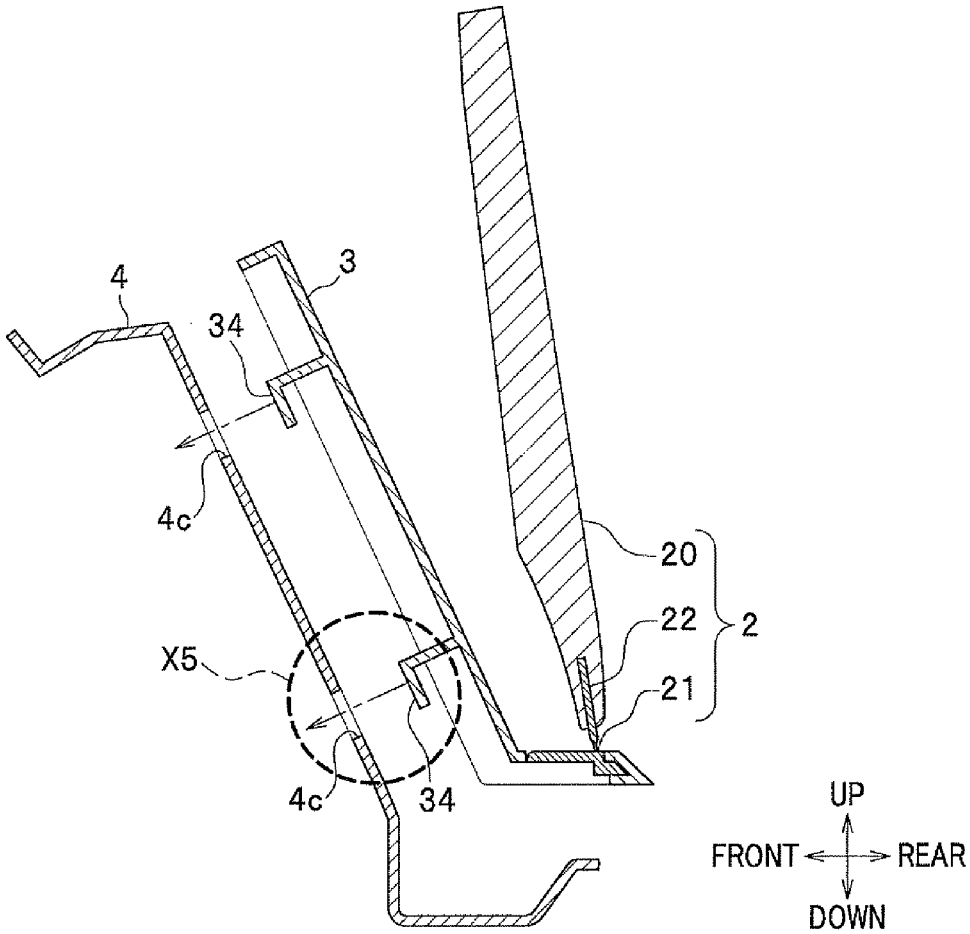
FIG. 7A is a sectional view of the stopper bracket provided with an approximately L-shaped mounting nail.

Also, as shown in FIG. 7A, the stopper bracket 3 may be provided with a mounting nail 34 having an approximately L shaped cross section, and the mounting bracket 4 may be provided with a mounting hole 4*c* into which the mounting nail 34 is inserted.

Figure 7B:
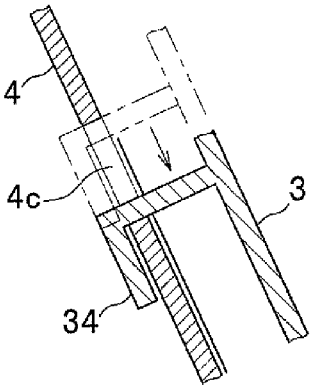
FIG. 7B is an enlarged partial sectional view showing the section X5 of FIG. 7 with the stopper bracket being attached to the mounting bracket.

As shown in FIG. 7B, when the stopper bracket 3 is attached to the mounting bracket 4, the worker inserts the mounting nail 34 into the mounting hole 4*c*, and slides the stopper bracket 3 in a direction indicated by an arrow, i.e., in the direction of an open side of the L-shape of the mounting nail 34.

When the L-shape of the mounting nail 34 sandwiches the mounting bracket 4, the stopper bracket 3 is surely fixed to the mounting bracket 4.

Figure 7C:
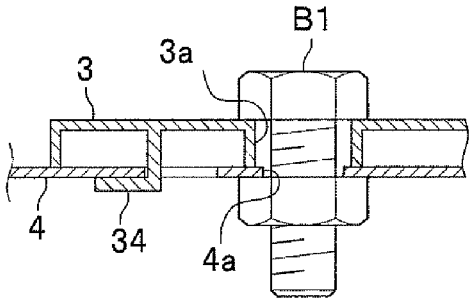
FIG. 7C is a sectional view showing a fixing hole of the stopper bracket and a bolt hole of the mounting bracket with the stopper bracket being attached to the mounting bracket.

Also, the mounting nail 34 facilitates positioning of the stopper bracket 3 at the time of attaching the stopper bracket 3 to the mounting bracket 4, and the worker can easily position a plurality of fixing holes 3*a* (see FIG. 7C) of the stopper bracket 3 to a plurality of bolt holes 4*a* (see FIG. 7C) of the mounting bracket 4. Further, as shown in FIG. 7C, because the mounting nail 34 having the approximately L shaped cross section coherently attaches the stopper bracket 3 to the mounting bracket 4, the worker can easily fasten the stopper bracket 3 to the mounting bracket 4 by the bolt B1.

Therefore, the worker can easily attach the stopper bracket 3 to the mounting bracket 4.

From the above, as shown in FIG. 2, the pad member 2 is fitted into the stopper bracket 3 in the pedal device 1 (see FIG. 1) according to this embodiment.

On the bottom face 21*b* of the pad-side fitting section 21 of the pad member 2, the thick fitting nail 24 having high stiffness is located at a location opposite to the pad 20, and the fitting nail 24 is inserted into the insertion section 32 (see FIG. 3B).

According to this structure, when the driver depresses the pad 20, the thick fitting nail 24 whose stiffness is higher than that of the engagement nail 23 can receive the load applied to the pad member 2 downward. As a result, the pedal device 1 which does not tend to be degraded over the years can be obtained.

Also, the engagement nail 23 (see FIG. 3A) whose stiffness is lower than that of the fitting nail 24 can be prevented from receiving a large load. As a result, the pedal device 1 which does not tend to be degraded over the years can be obtained.

Further, as shown in FIG. 4B, the fitting nail 24 is inserted into the insertion section 32, thereby resulting in high strength of the fitting nail 24 of the pad member 2 fitted into the stopper bracket 3. As a result, the pedal device 1 which does not tend to be degraded over the years can be obtained.

Also, as shown in FIGS. 4A and 4B, the pad member 2 is fixed to the stopper bracket 3 by the snap-fit mechanism which elastically deforms the engagement nail 23 of the pad member 2 so as to be engaged with the engagement section 33 of the stopper bracket 3 in the pedal device 1 according to this embodiment (see FIG. 1).

According to this structure, the worker can easily fit the pad member 2 into the stopper bracket 3, and further can attach the stopper bracket 3 to the mounting bracket 4 by the plurality of bolts B1 as shown in FIG. 5A. Therefore, the worker can easily assemble the pedal device 1.

Also, the worker can easily remove the stopper bracket 3 fitted into the pad member 2 from the mounting bracket 4 by removing the plurality of bolts B1, and further can easily remove the pad member 2 fixed to the stopper bracket 3 by the snap-fit mechanism from the stopper bracket 3.

As described above, as shown in FIG. 1, the pad member 2 can be fixed to the stopper bracket 3 by the snap-fit mechanism in the pedal device 1 according to this embodiment.

Also, the fitting nail 24 having high stiffness can receive the load which is applied via the pad 20 (see FIG. 2).

Therefore, the pad member 2 can easily be attached to the stopper bracket 3, and the pedal device 1 which does not tend to be degraded over the years can be obtained.

What is claimed is:

1. A pedal device comprising:

a stopper member attached to a floor of a driver's seat of a vehicle; and a pad member which is fitted into the stopper member and has a pad to receive a depression force exerted by a driver, the pad member including:

a pad-side fitting section having an engagement nail at one end thereof and a fitting nail at the other end thereof, the engagement nail being elastically deformable and having a supporting plate and an engagement projection which is provided on the supporting plate and projects toward a front side of the vehicle, and the fitting nail projecting toward a rear side of the vehicle opposite to the engagement nail and having a sloped section; and a hinge section to connect the pad to the pad-side fitting section, wherein the stopper member has a stopper-side fitting section including an engagement section with which the engagement nail is engaged, and a concave insertion section into which the fitting nail is inserted, the hinge section is provided at a rear side of the pad side fitting section, and the fitting nail is formed at a location which is opposite to the hinge section, wherein the hinge section is provided on the pad-side fitting section at a position which overlaps with the fitting nail in a vertical view, wherein the stopper member has a through hole through which the pad member passes in the vertical direction of the vehicle, the engagement section and the insertion section are formed at a peripheral portion of the through hole respectively, and a thickness of the pad member is less than a width of the through hole in a front-rear direction of the vehicle above the fitting nail, and wherein the stopper member is provided with the concave insertion section which caves from the through hole toward the rear side of the vehicle, the fitting nail is inserted into the concave insertion section, the engagement section provided on the stopper member is provided with an engagement hole which passes through from the through hole toward the front side of the vehicle, and the engagement nail is inserted into the engagement hole.

2. The pedal device according to claim 1, further comprising a bracket which is fixed to the floor, and to which the stopper member is attached, and the bracket is provided with a supporting section to support at least one of the engagement nail which is engaged with the engagement section and the engagement section from the floor side.

3. The pedal device according to claim 2, wherein the engagement nail is provided between a tip of the engagement section and a tip of the supporting section.

4. The pedal device according to claim 1, wherein the engagement projection is disposed at a lower end of the supporting plate which extends downwardly in a vertical direction of the vehicle and projects toward a front of the vehicle, the fitting nail projects toward the rear side of the vehicle, and the engagement nail is provided at a position lower than that of the fitting nail in the vertical direction of the vehicle.

5. The pedal device according to claim 1, wherein the fitting nail is longer than the engagement nail in a front-rear direction of the vehicle.

6. The pedal device according to claim 1, wherein the hinge section is disposed between the engagement nail and the fitting nail in the front-rear direction of the vehicle.

* * * * *